United States Patent [19]

Mantchev

[11] 3,945,540

[45] Mar. 23, 1976

[54] VALVULAR LIQUID DISPENSING CLOSURE

[76] Inventor: Marco Ivanov Mantchev, Rua Cupece 1784, Sao Paulo, Brazil

[22] Filed: Oct. 17, 1973

[21] Appl. No.: 407,069

[30] Foreign Application Priority Data

| | | |
|---|---|---|
| Oct. 18, 1972 | Brazil | 7299 |
| Dec. 5, 1972 | Brazil | 8578 |
| May 30, 1973 | Brazil | 4059 |

[52] U.S. Cl. ..... 222/525; 222/541

[51] Int. Cl.[2] ..... B67D 3/00

[58] Field of Search ..... 215/21, 22, 23; 222/522–525, 147, 182, 541, 500, 493; 220/466, 467

[56] References Cited

UNITED STATES PATENTS

| | | | |
|---|---|---|---|
| 623,010 | 4/1899 | Greenhow | 215/21 |
| 1,072,606 | 9/1913 | Griswold | 222/500 |
| 2,256,722 | 9/1941 | Martin | 222/500 |
| 2,765,960 | 10/1956 | Soffer et al. | 222/182 |
| 3,107,829 | 10/1963 | Makowski | 222/525 |
| 3,262,613 | 7/1966 | Miller | 222/522 |
| 3,369,712 | 2/1968 | Osrow | 222/182 |

*Primary Examiner*—Drayton E. Hoffman
*Assistant Examiner*—Larry H. Martin
*Attorney, Agent, or Firm*—Michael J. Striker

[57] ABSTRACT

For the closure of bottles and similar containers for liquid substances, it is foreseen an improved dispensing closure with valve means and safety means constituted of an axially gravity actuated sliding plugger working into a sleeve mounted on the bottle neck, the plugger having a downward opening to fit the stem of an ogive head shaped safety clogging means, whose seat is obtained from the converging walls of an inner section of said sleeve, projecting into the bottle mouth, the whole valve assembly being protected by a pressure cap fitting over the said sleeve.

10 Claims, 7 Drawing Figures

VALVULAR LIQUID DISPENSING CLOSURE

DESCRIPTION OF THE INVENTION

This invention is broadly referred to dispensing closures for bottles and more specifically to valvular closures whose main feature is found in the improved construction leading to a more practical-to-use and easy-to-manufacture structure.

The value closure means of this invention is designed for bottles and the like containing non-pressurized liquids such as liqueurs, soft and hard beverages and similars which are usually consumed in a relatively long period thus making necessary a leak-proof and ready-to-use dispensing device closing the bottle mouth.

As it is known by those skilled in the art, all dispensing closures of this type need special machinery for the permanent fitting on the neck of the bottle, not mentioning the bulky and expensive safety arrangements heretofore designed and employed trying to prevent unauthorized persons to substitute or to re-fill the bottle with falsified or counterfeited liquid all of this leading to a substantial increase in manufacturing costs.

It is so a primary object of this invention to provide an improved dispensing closure structure for bottles and the like, having a neck and mouth with a simpler and cheaper construction.

It is another object of this invention to provide a valvular dispensing closure for bottles or neck-provided containers which allows a leak-proof shut-off and prevent any dripping when in fluid-delivering position.

Yet another object of this invention is to provide a valvular dispensing closure as defined above, having a safety arrangement to prevent any unauthorized re-filling or substitution of the originally filled in liquid.

These and other advantages of this invention will become apparent from the following description thereof, made in the light of the attached drawing in which it is illustrated in a preferred embodiment given by way of examples.

Figure 1:
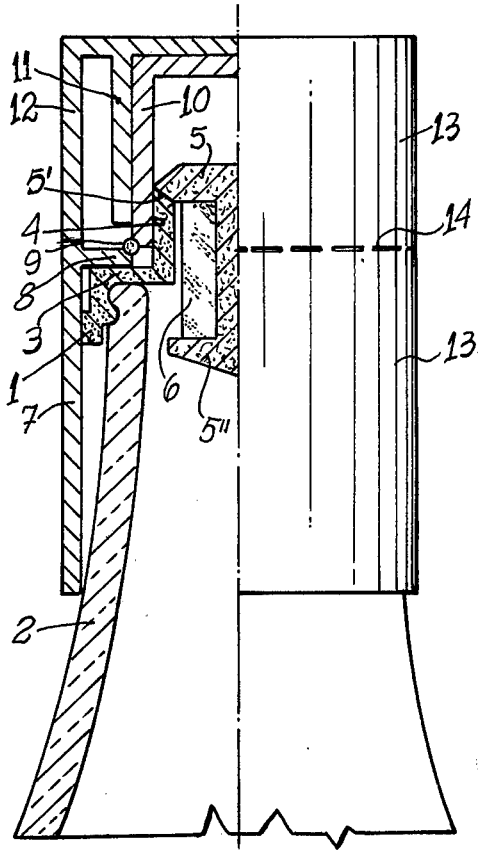
FIG. 1 shows a fragmentary view of the dispensing closure of a preferred first embodiment of this invention cut from an axial plane.

In accordance with the attached drawings, it is seen in FIG. 1 that the liquid dispensing closure of this invention is mainly constituted of a collar 1 made of relatively resilient material, which is tightly fitted over the mouth of the bottleneck 2, having an intermediate horizontal section 3 limiting the upwardly projected cylindrical end section 4 which defines an axial constriction of the said mouth while acting as guiding means for the sliding stopper or valvular element 5.

This stopper 5 is substantially constituted of an "I" longitudinal section body provided with vertical radially disposed wings 6 having, the upper flanged portions of the body 5, a tapered circumference defining a complementing surface 5' matching the conical seat 4' foreseen on the free end of the said cylindrical projections 4.

The lower flanged portions 5'' of the said valvular element 5 abuts peripherically with the innermost corner of the said horizontal section 3 thus playing the role of a limiting device for the forward movement of the stopper 5.

The aforementioned stopper 5 slides inside the chamber defined by the cylindrical cap 10 that, after the filling in of the bottle with the desired liquid, is spacedly welded or fixed to the annular section 8 of the downwardly projected neck 7 of the bottle cap 12, by means of the easily breakable attaching points 9.

The said cap 12 is mechanically pressed over the said resilient collar 1 so as to make unremovable the lower projection 7 whilst the upper part of the cap set 12 may be removed from the bottle mouth by a right or left slight rotation followed by its lifting vertically.

The said cap 12 is furtherly provided with a concentric internal wall 11 which is tightly engaged and cooperates with the inner cap 10, thus forming the whole set of outer and inner cap 12, 10 a removable structure.

As schematically shown in FIG. 1, during transportation and handling of the bottles, beside the said welding spots 9, there is also provided a general covering of metallized paper 13, having a punched line 14 on the same plane of the welding spots 9, thus ensuring a perfect sealing of the cap which allows a quick releasing and uncovering of the dispensing device, by means of a simple rotary movement tearing the metallized paper 13 (or similar) and the welding spots 9 and allowing the easy removal of the cap assembly 12, 10.

Figure 2:
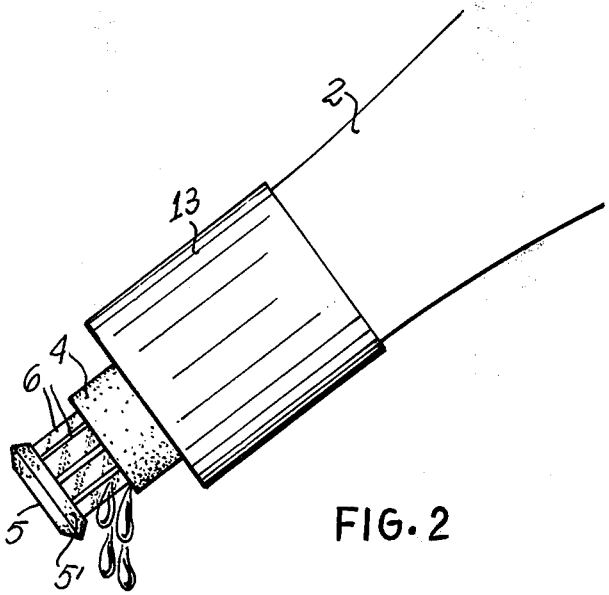
FIG. 2 shows the dispensing closure of FIG. 1 in working conditions.

In FIG. 2 it is seen how the slidable stopper 5 projects itself outside of the mouth level of the bottle, as a result of the tilting of the bottle, letting the liquid to flow outside through the passageways formed between two adjacent radial wings 6 of the stopper 5.

As an alternative construction, the dispensing closure of this invention may be provided with safety valve means as illustrated in FIGS. 3 to 7.

Figure 3:
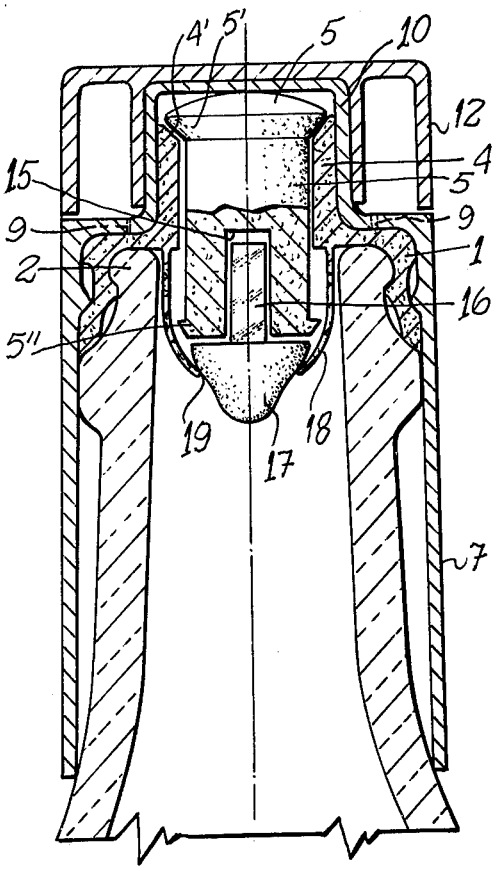
FIG. 3 is an elevational sectional view of another embodiment of the dispensing closure provided with safety valve means.
Figure 4:
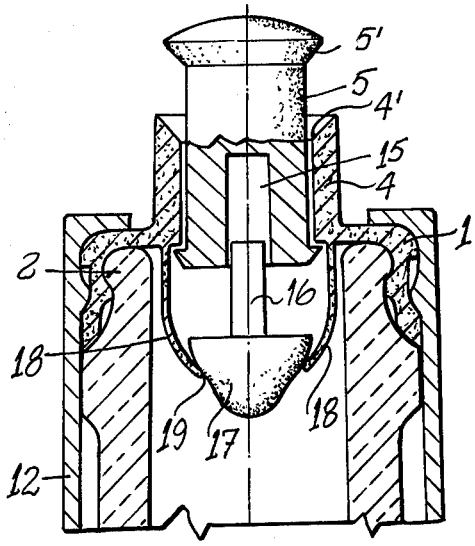
FIG. 4 shows the same device of FIG. 3 with the stopper forcedly up-raised and the safety valve means in shutoff conditions.

In regard of FIGS. 3 and 4, it is seen that the stopper 5 has a reel like shape with the upper and lower flanges 5',5'' acting the same way as in the firstly described construction, being the reel provided with a central hole 15 forming a cavity into which it is slidably and freely fitted the stem 16 of the safety valve element 17, made of glass or other high density material, having an ogive-like outline.

To form the seat of the said safety valve element 17, from the lower surface of the horizontal annular section 3 of the resilient collar 1, it is foreseen a curved receptacle 18 with an axial opening 19 through which is allowed to pass only the apex portion of the said ogive-like head in which position the stem end will still be guided into said cavity 15.

The way this safety device functions and how much it guarantees against unauthorized substitution of the liquid contents, is illustrated in FIG. 4 where it is shown the result of an imagined attempt to make the refilling of the bottle by forcedly lifting the stopper 5, in the assumption to free the passage for the injection of a falsified liquid, verifying, although, that this will not be possible due to the occured plunging of the safety device 17 which closes under leak-proof conditions the remaining passageway 19.

The only way to have the safety device 17 leaving its seat 19 is by tilting the bottle causing both the stopper and the plunger valve elements 5 and 17 to slide outside under gravity. Of course, under such circumstance the liquid may only be delivered outside.

Figure 5:
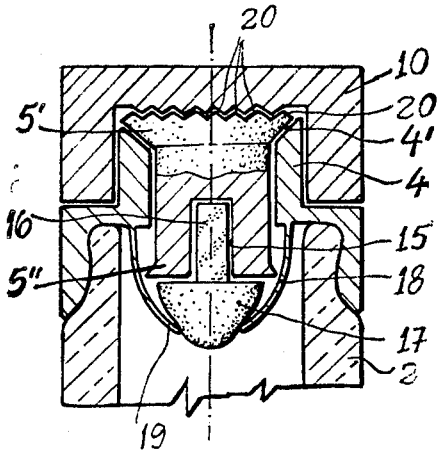
FIG. 5 shows an alternative embodiment of the safety device.
Figure 6:
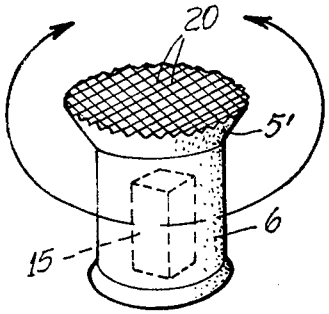
FIG. 6 is a perspective view of the stopper of FIG. 5.
Figure 7:
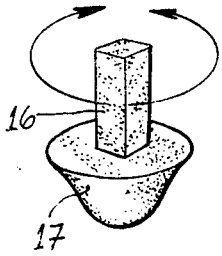
FIG. 7 shows in a perspective view the safety means of FIG. 5.

In FIGS. 5, 6, and 7 it is seen another alternative construction of the said dispensing closure and safety device structure, in which the said stem 16 freely receiving chamber 15 has a preferred square section or other non-circular section, obviously complementary to the stem 16 prismatic section.

The reel-like stopper 5 is provided with an upper flanged portion 5' with a greater diameter than the lower one 5'' and both the facing surfaces of the top of the said larger flange 5' and of the bottom of the inner cap 10 are matchingly provided with indentations or grooves 20.

All of the illustrated features of the prismatic section of the stem 16 engagement and of the grooved matching surfaces of the stopper and covering cap 10 are intended to solidarize the valve assembly to make it all turnable along with the rotation of the outer cap 12 thus causing a brushing effect of the abutting surfaces 5' and 17 of the stopper and plunger safety elements against their respective seats 4' and 19 (FIG. 5) thus preventing the glueing of such valve elements due to the adhesive action of the sugar usually contained in a rather high percentage in liqueurs or sweet beverages.

Of course, this invention was described and illustrated by way of example, being admitted a lot of constructive adaptations without exorbitating from its scope as it may be verified, by the fact that in the figures of the attached drawing, the component parts have been diferently designed, being this a mere question of choice in accordance with the particular use which the dispensing closure of this invention is intended to.

What I claim is:

1. A closure for containers, particularly bottles, comprising a closure member mounted on a container and having a passage adapted for alignment with an opening of the container, said closure member forming an outer and an inner valve seat; cap means surrounding said closure member and having a turnable portion which is removable from said container; a plug member freely movable under the influence of gravity in said passage between a first storage position and a second dispensing position, said plug member having an outer valve portion and an inner valve portion respectively engaging said outer and inner valve seats when said plug member is in said first storage position, said outer valve portion having an end facing said turnable portion of said cap means and a polygonal recess at its opposite end, said inner valve portion having a mating stem portion received in said polygonal recess; and cooperating engaging portions on said turnable portion of said cap means and said outer valve portion so that, when said turnable portion is removed from said container, said inner and outer valve portions move relative to their seats so as to break any adherence between said valve portions and their cooperating valve seats.

2. A closure for containers as defined in claim 1, wherein said container is a bottle having a neck, and wherein said closure member is formed of resilient material mounted in tight frictional engagement with said neck.

3. A closure for containers as defined in claim 2, wherein said closure member comprises a first annular portion extending substantially vertically of said neck and containing said passage for axial movement of said plug member and, said outer valve seat having a first engageable surface, and a second annular portion which is pressed over said neck so as to surround the same and to maintain tight frictional engagement therewith and having a second engageable surface.

4. A closure for containers as defined in claim 3, wherein said plug member is of I-shaped cross-section, and further comprises axially spaced first and second abutment means, said first position being assumed when said first abutment means abuts said first engageable surface, and said second position being assumed when said second abutment means abuts said second engageable surface, whereby the contents of a container can be emptied through said passage without said plug member being manually removed off the container.

5. A closure for containers as defined in claim 1, wherein said plug member comprises a cylindrical body portion of smaller diameter than said opening of said container, and a plurality of axially-extending radial projections defining channels with each other within said passage, whereby the contents of a container can be emptied through said passage via said channels wherever said plug member is not in said first position.

6. A closure for containers as defined in claim 1, said cap means comprising a metallic annular sleeve member pressed into tight frictional engagement with said closure member, and said turnable portion being manually-tearable, so that the absence of said manually-tearable turnable portion offers a subsequent user visible proof of prior usage of the container.

7. A closure for containers as defined in claim 6, wherein said removable turnable portion is provided with breakable metallized paper circumferentially spaced about said annular sleeve member, so that a manual rotary motion will tear said metallized paper.

8. A closure for containers as defined in claim 7; said inner valve portion being supported by said closure member and cooperating with said plug member, so that a container cannot be refilled when the container is oriented in any of said positions.

9. A closure for containers as defined in claim 8, wherein said stem portion is adapted to be received fully into said recess when said plug member assumes said first position, and partially received into said recess when said plug member assumes said second position; and wherein said inner valve portion has an ogive -shaped head portion connected with said stem portion and adapted to fit within said opening of a container and cooperating with said closure member to completely close said opening, whereby the contents of a container cannot be adulterated when the container is upright.

10. A closure for containers as defined in claim 9, wherein said stem and said recess is of substantially rectangular configuration, and wherein said plug member has an annular head portion of larger diameter than said opening of said container, and wherein said cooperating engaging portions include roughened surfaces on said turnable portion and on said end of said outer valve portion facing said turnable portion, said roughened surfaces being adapted to engage each other.

* * * * *